US005944318A

United States Patent [19]

Payton

[11] Patent Number: 5,944,318

[45] Date of Patent: Aug. 31, 1999

[54] FLYING DISC TARGET GAME APPARATUS

[76] Inventor: Michael B. Payton, 8720 E. Hurst Rd., Pekin, Ind. 47165

[21] Appl. No.: 08/940,444

[22] Filed: Sep. 30, 1997

[51] Int. Cl.[6] ..... A63B 63/00

[52] U.S. Cl. ..... 273/402; 473/476

[58] Field of Search ..... 273/398, 400, 273/401, 402; 473/197, 454, 455, 462, 470, 471, 476, 478

[56] References Cited

U.S. PATENT DOCUMENTS

| | | | |
|---|---|---|---|
| 613,383 | 11/1898 | Morgan | 273/26 |
| 1,208,235 | 12/1916 | Thager | 273/26 |
| 1,258,931 | 3/1918 | Newcombe | 273/26 |
| 2,126,102 | 8/1938 | Fowler | 273/26 |
| 2,580,799 | 1/1952 | Lauterbach | 273/105 |
| 2,932,516 | 4/1960 | Penner | 273/105 |
| 3,312,467 | 4/1967 | Dawson | 273/26 |
| 3,583,703 | 6/1971 | Brown | 273/26 |
| 4,079,939 | 3/1978 | Raistakka | 273/105 |
| 4,168,066 | 9/1979 | Sole et al. | 273/95 |
| 4,295,648 | 10/1981 | Stromback | 273/26 |
| 4,718,668 | 1/1988 | Schipske | 273/29 |
| 4,826,166 | 5/1989 | Baker et al. | 273/55 |
| 4,828,270 | 5/1989 | Chiang | 273/401 |
| 4,842,284 | 6/1989 | Rushing et al. | 273/395 |
| 5,351,948 | 10/1994 | Thomas | 273/400 X |

*Primary Examiner*—William H. Grieb

*Attorney, Agent, or Firm*—Middleton & Reutlinger; James C. Eaves, Jr.

[57] ABSTRACT

A target game apparatus for use with a flying disc to be thrown includes an open framework structure to be supported upright on the surface, a target suspended within the confines of the open framework by a plurality of tensioned elastic straps interconnecting the target to the framework structure, and a net attached to the rear of the framework structure to retain the flying disc thrown.

19 Claims, 12 Drawing Sheets

FLYING DISC TARGET GAME APPARATUS

BACKGROUND OF THE INVENTION

The present invention relates to amusement devices and games, and more particularly to such devices and games having a target at which an article or object is to be thrown.

Amusement devices and games of the type having a target at which an article or object to be thrown are, per se, known. U.S. Pat. No. 2,126,102 teaches a baseball pitching target with a net to retain the baseball, and with adjustable turnbuckles to make the target taught.

U.S. Pat. No. 3,312,467 teaches a baseball pitcher's practice device with two fixed vertical elastic cords, and two adjustable horizontal elastic cords that slide up and down the two vertical tubular stand members to alter the strike zone. U.S. Pat. No. 3,583,703 teaches a practice pitching device that can be disassembled into a plurality of component frame parts of predetermined, generally uniform length, with the intent to package this device for convenience of storage and portability.

U.S. Pat. No. 4,168,066 teaches a gliding disc projectile and target game to be used by two players. In one embodiment the target game apparatus includes a vertical support rod having ground support legs at the bottom end and a plurality of adjoining hoops at the top end, each of the hoops being of different size. In another embodiment, the target game apparatus includes a support frame having two vertical legs and a top bar extending across and connecting to the top ends of the legs. A plurality of adjoining hoops of different size are directly connected to the top bar and legs. The object is for the players to stand to opposite sides of the target game apparatus and propel the disc-shaped projectile through selected hoops so as the opposing player may catch the projectile.

SUMMARY OF THE INVENTION

The present invention provides a game target apparatus having an open framework, a target suspended within the confines of the open framework by tensioned elastic straps, and a net located and mounted to the back of the framework to retain the object thrown, a flying disc.

The present invention further provides a target game apparatus of the class described including a framework which can be assembled or disassembled without the aid of tools, and a target and net that can be applied to the open framework by touch.

More particularly, the present invention provides a new game for a flying disc comprising of, an open framework, a target suspended by elastic straps that provide rebound capabilities, and a net to retain the flying disc. Points are scored with the flying disc by throwing said flying disc through the multiple scoring areas of this game target apparatus to a predetermined total of points to win, generally one hundred to five hundred points, depending on the ability of the participant(s).

BRIEF DESCRIPTION OF THE DRAWINGS

A better understanding of the invention will be had upon reference to the following descriptions in conjunction with the accompanying drawings, wherein like numbers refer to like parts throughout the several views and in which.

DETAILED DESCRIPTION OF THE PREFERRED EMBODIMENT

Figure 1:
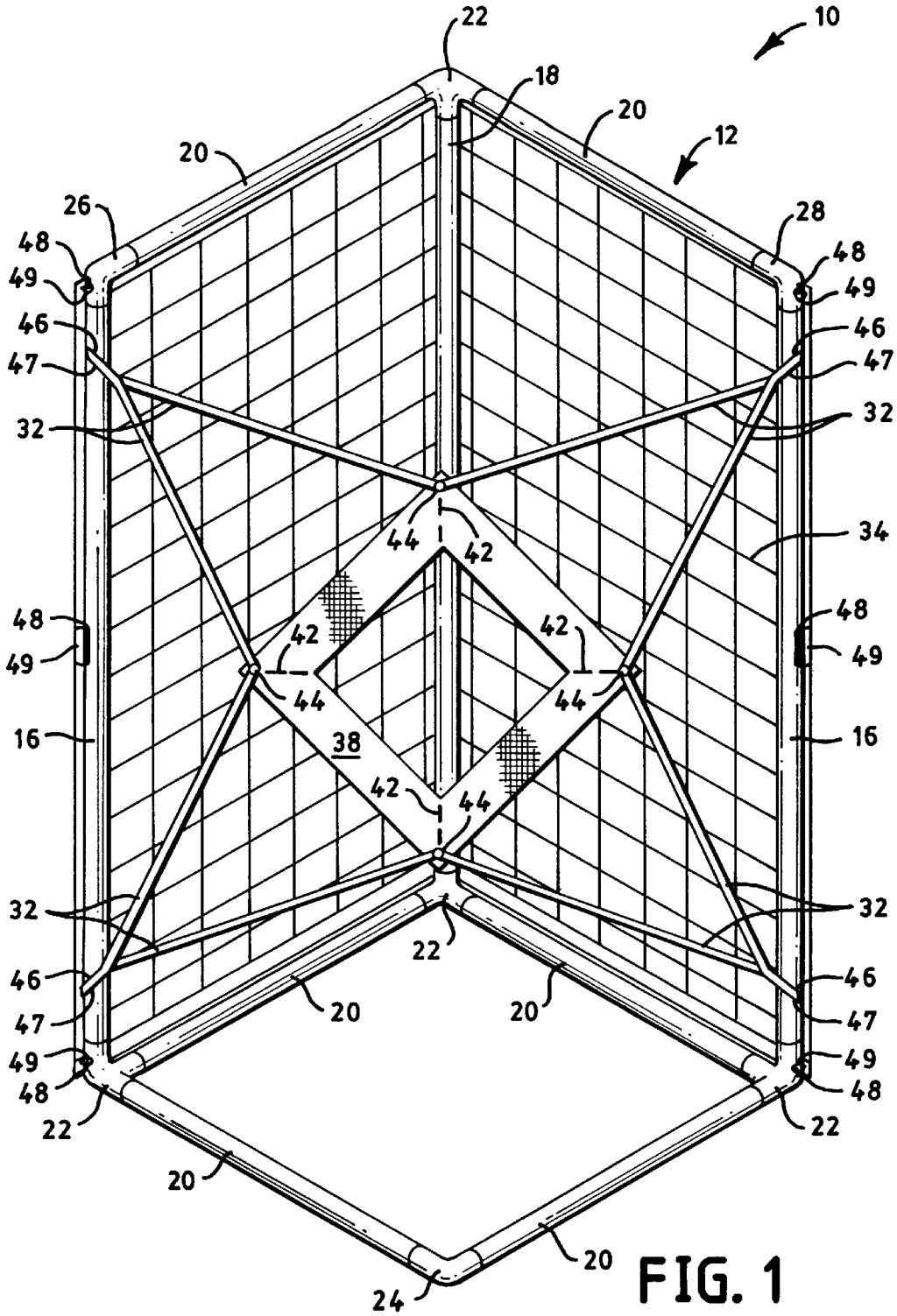
FIG. 1 is a front perspective view of the target game apparatus in its erected form.
Figure 3A:
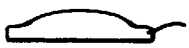
FIG. 3A is a side view of the flying disc used with this target game apparatus.
Figure 3B:
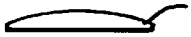
FIG. 3B is a side view of a different style of flying disc that could be used with this target game apparatus.

With reference to the Figures and in particular FIG. 1 and also FIG. 3A, shown is the target game apparatus, generally denoted as the numeral 10, of the present invention to be used with an article to be thrown at the target game apparatus, the article to be thrown, a flying disc 51. The target game apparatus 10 comprises an open framework 12 to be supported on the surface, a target 14, and a net 34 that attaches to the rear of the open framework 12.

Figure 4:
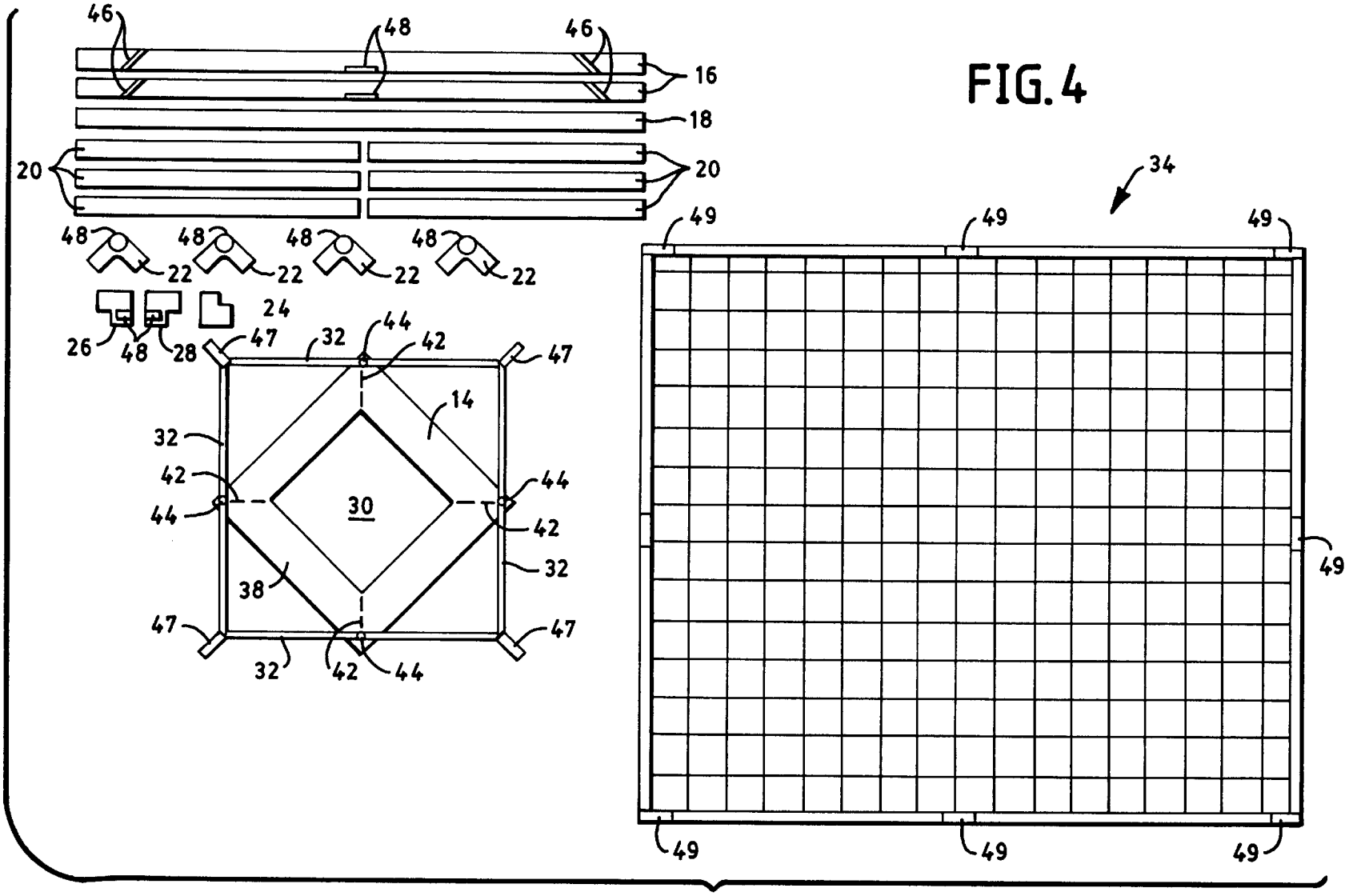
FIG. 4 is a disassembled view of the components relative to constructing this target game apparatus.
Figure 5:
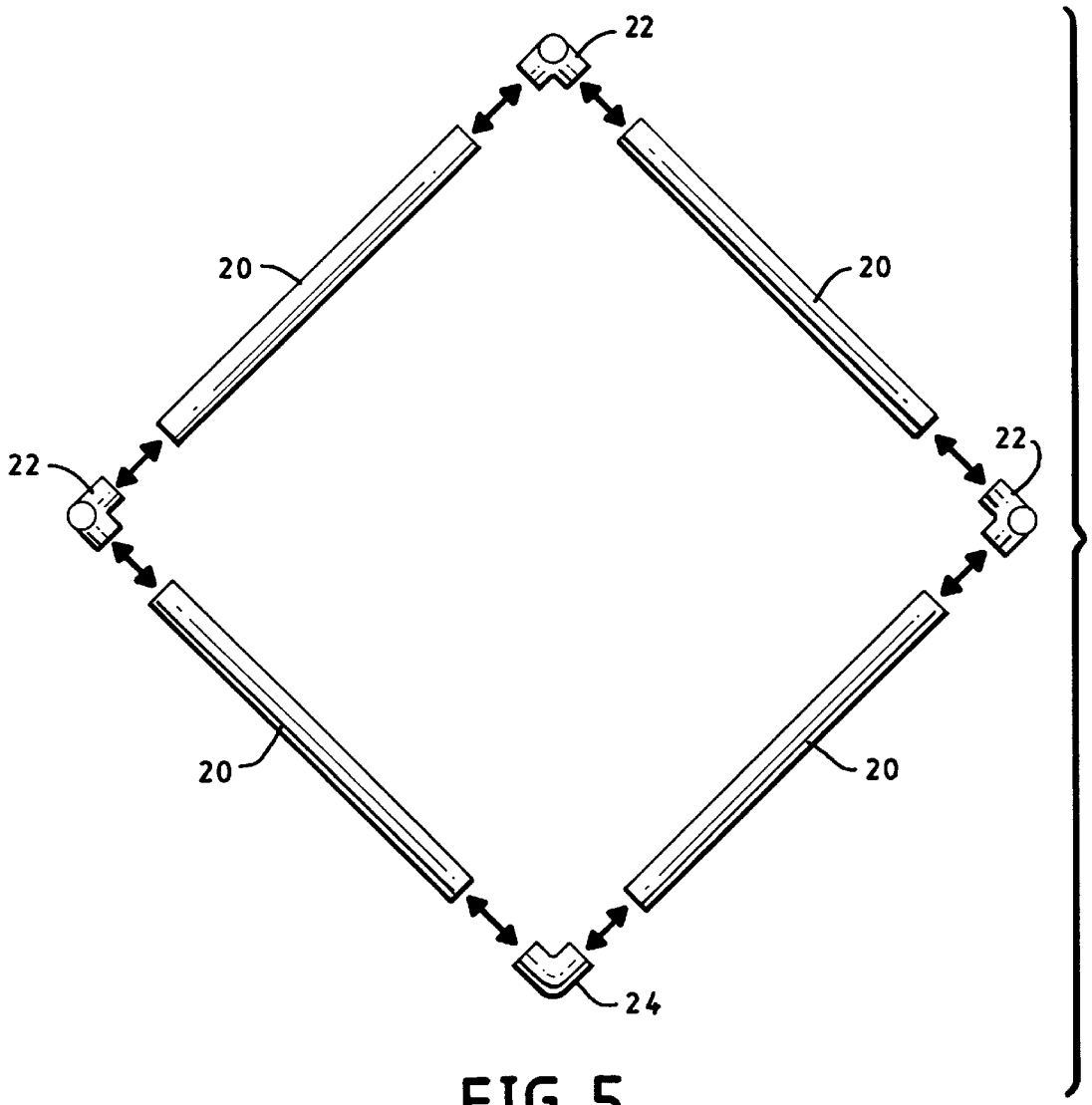
FIG. 5 is an illustrated top view of the components required to support this target game apparatus on the surface of the ground or floor.
Figure 6:
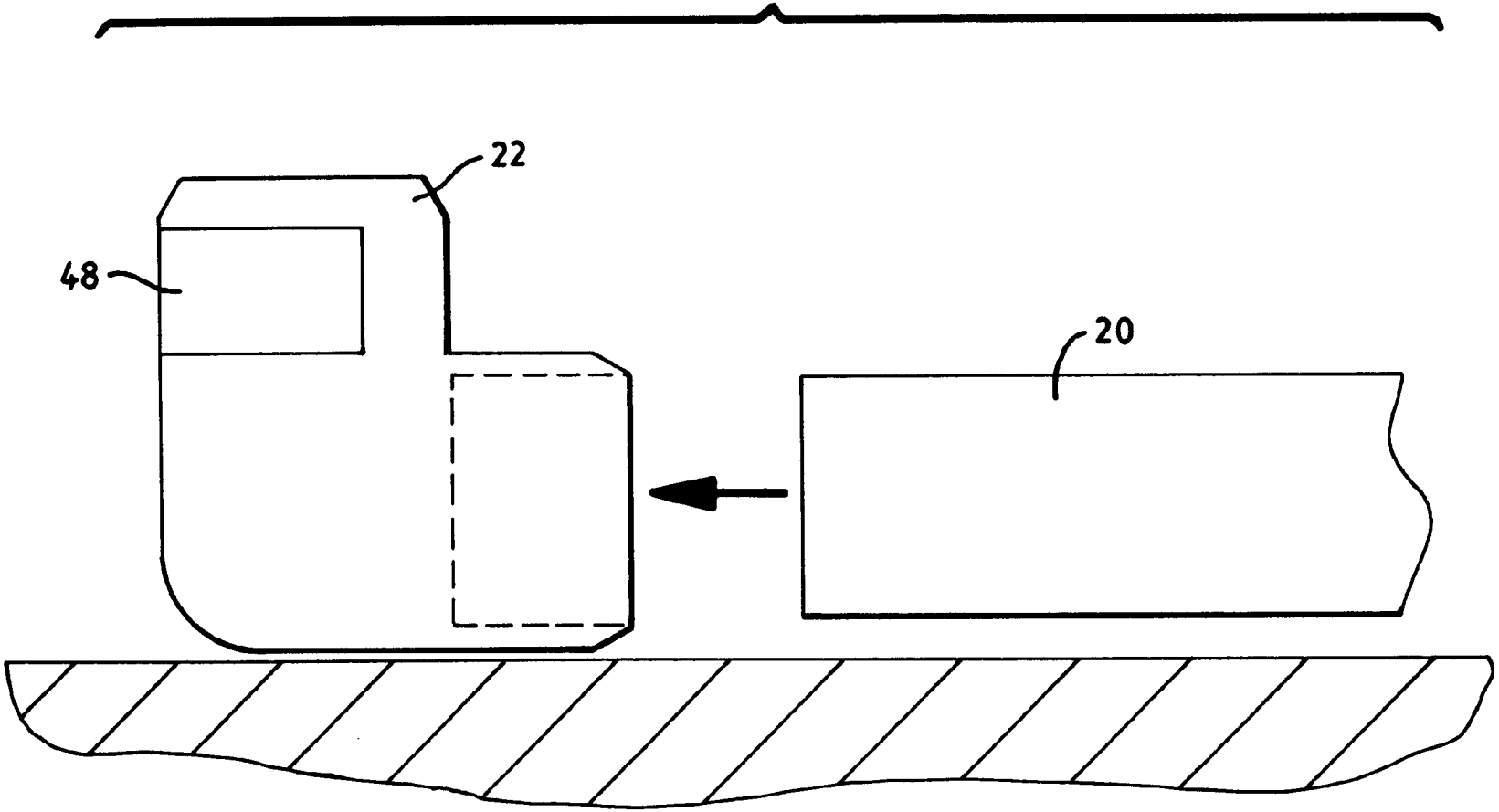
FIG. 6 illustrates how this target game apparatus framework assembles with no tools.
Figure 7:
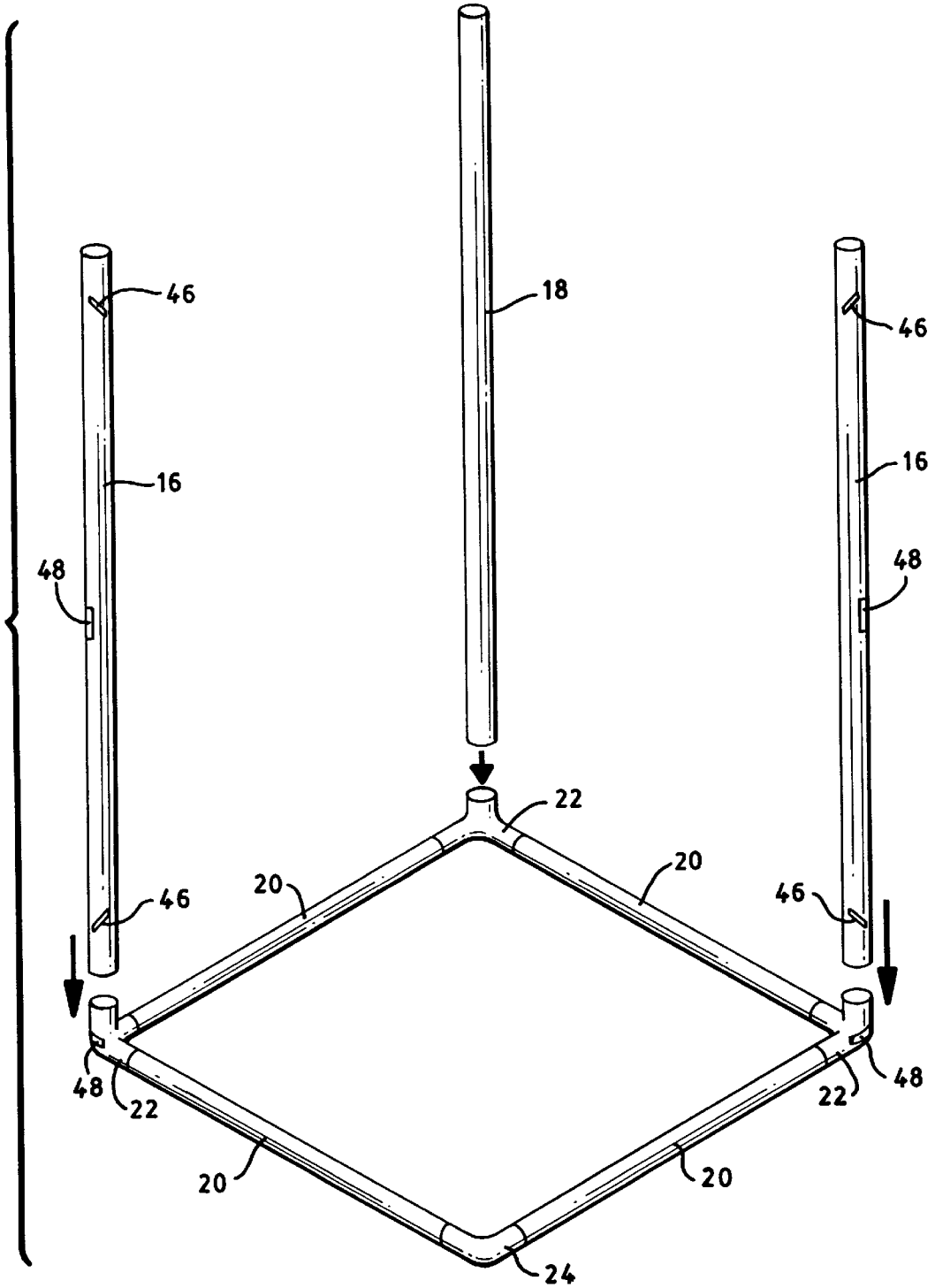
FIG. 7 illustrates how the vertical support members mount into the support base of this target game apparatus.
Figure 8:
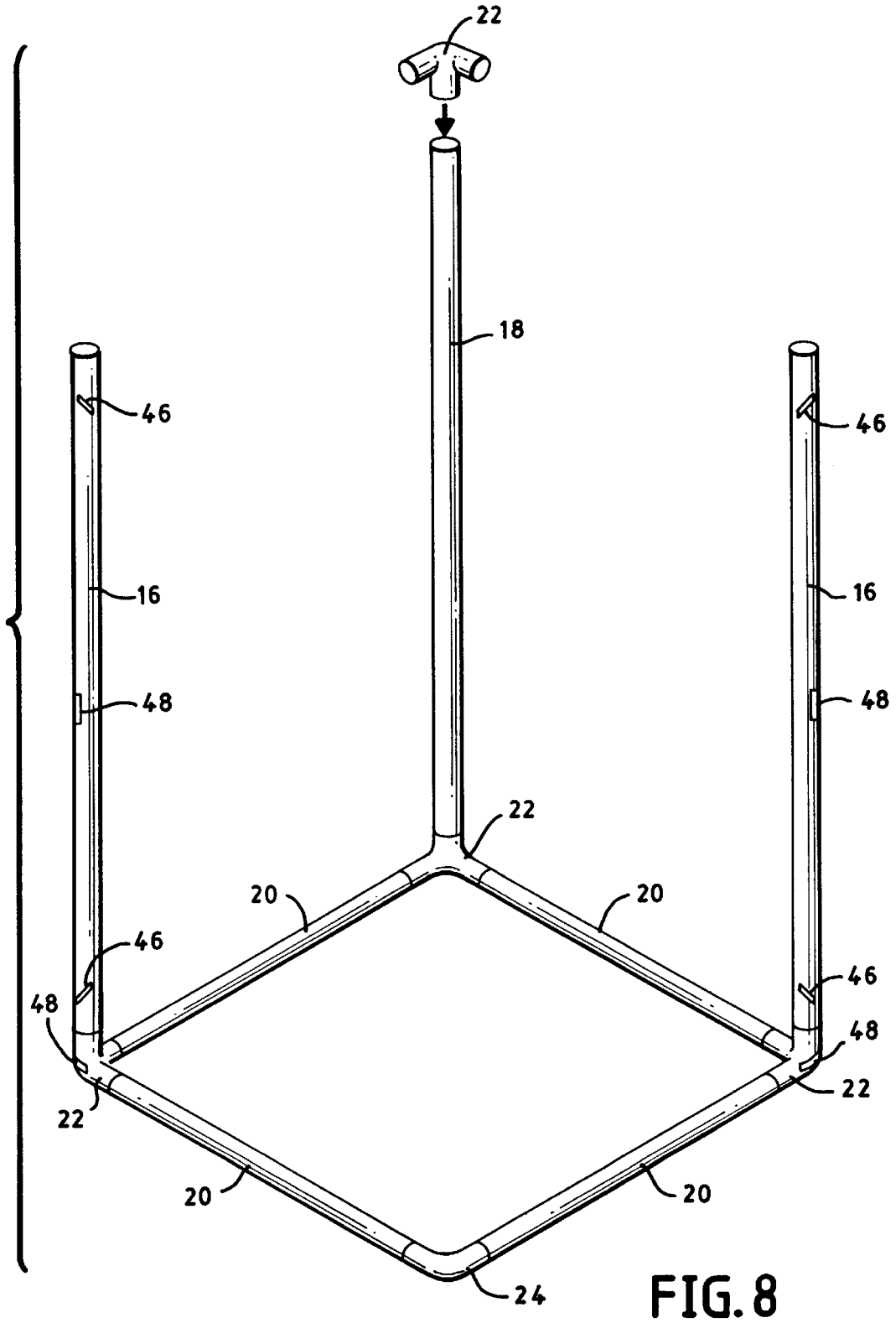
FIG. 8 illustrates a like three-way fitting mounting to the top of the rear vertical support member.
Figure 9:
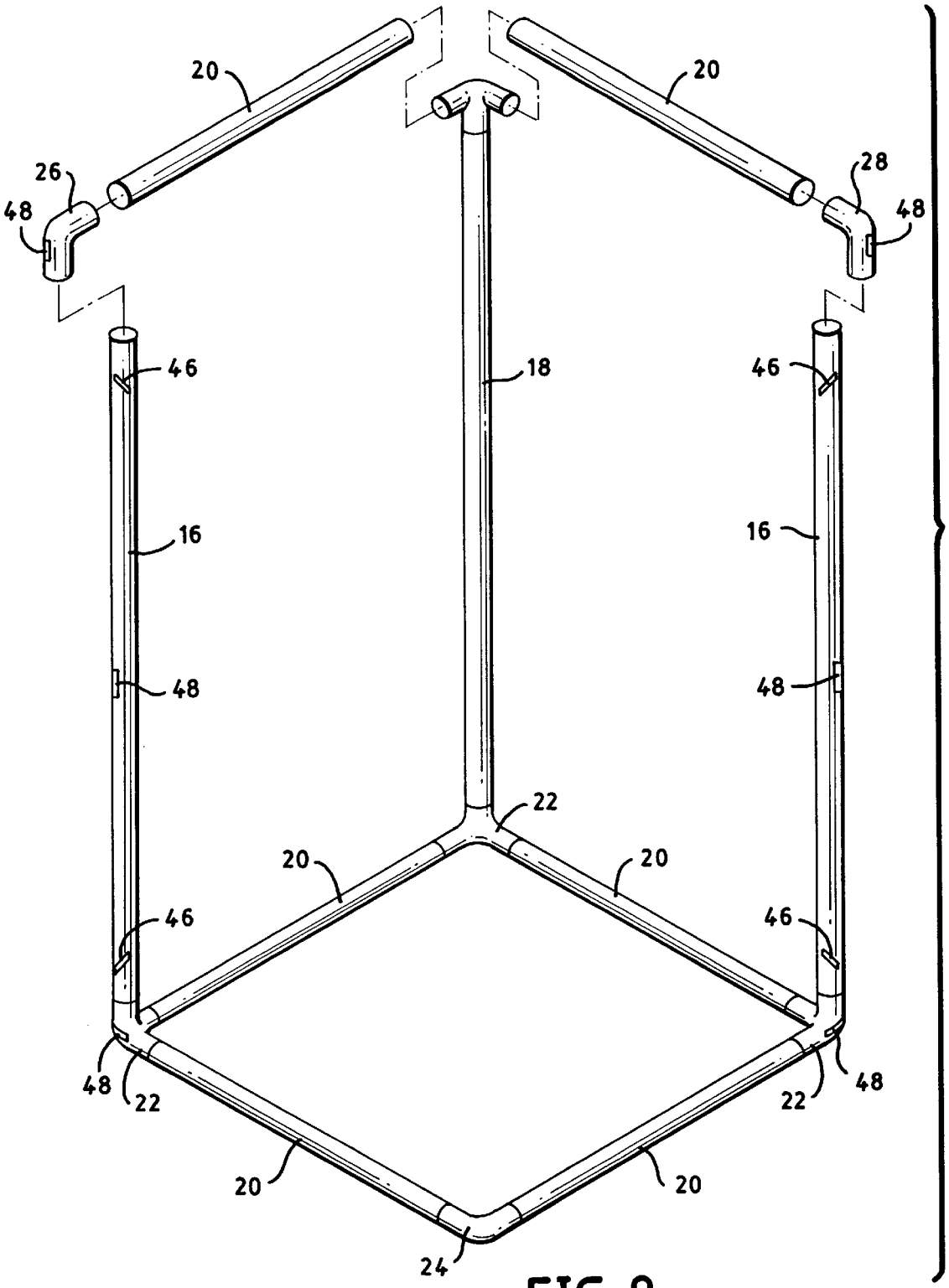
FIG. 9 illustrates how the like side vertical support members interconnect with the plain rear vertical support member to complete the framework of this target game apparatus.

With reference to FIG. 1 and also FIG. 4, the open framework 12 includes two like vertical side members or tubes 16, one plain vertical rear member or tube 18, six like horizontal members or tubes 20, four like three-way members or fittings 22, one plain two-way member or fitting 24, one opposing two-way member or fitting 26, and one opposing two-way member or fitting 28. The six like horizontal members or tubes 20, link the three vertical members or tubes 16 and 18 with four like three-way members or fittings 22, one plain two-way member or fitting 24, and two opposing two-way members or fittings 26 and 28 with a fashion of male/female connections that are pushed together at joints created by said members or fittings 22, 24, 26, and 28 as shown in FIGS. 5–10.

With reference to FIGS. 1, 2, 4, 11A, B, C, and 14, the target 14 is a rigid peripheral structure defining a central opening 30, larger than the article to be thrown, a flying disc 51. The target 14 is disposed within the confines of the open framework 12, transversely centered therein and spaced between the like horizontal members or tubes 20. More particularly, the target 14, is planar, attached to the two like vertical side members or tubes 16, and is located between and equally spaced to the said like vertical side members or tubes 16 and the like horizontal members or tubes 20.

Figure 12:
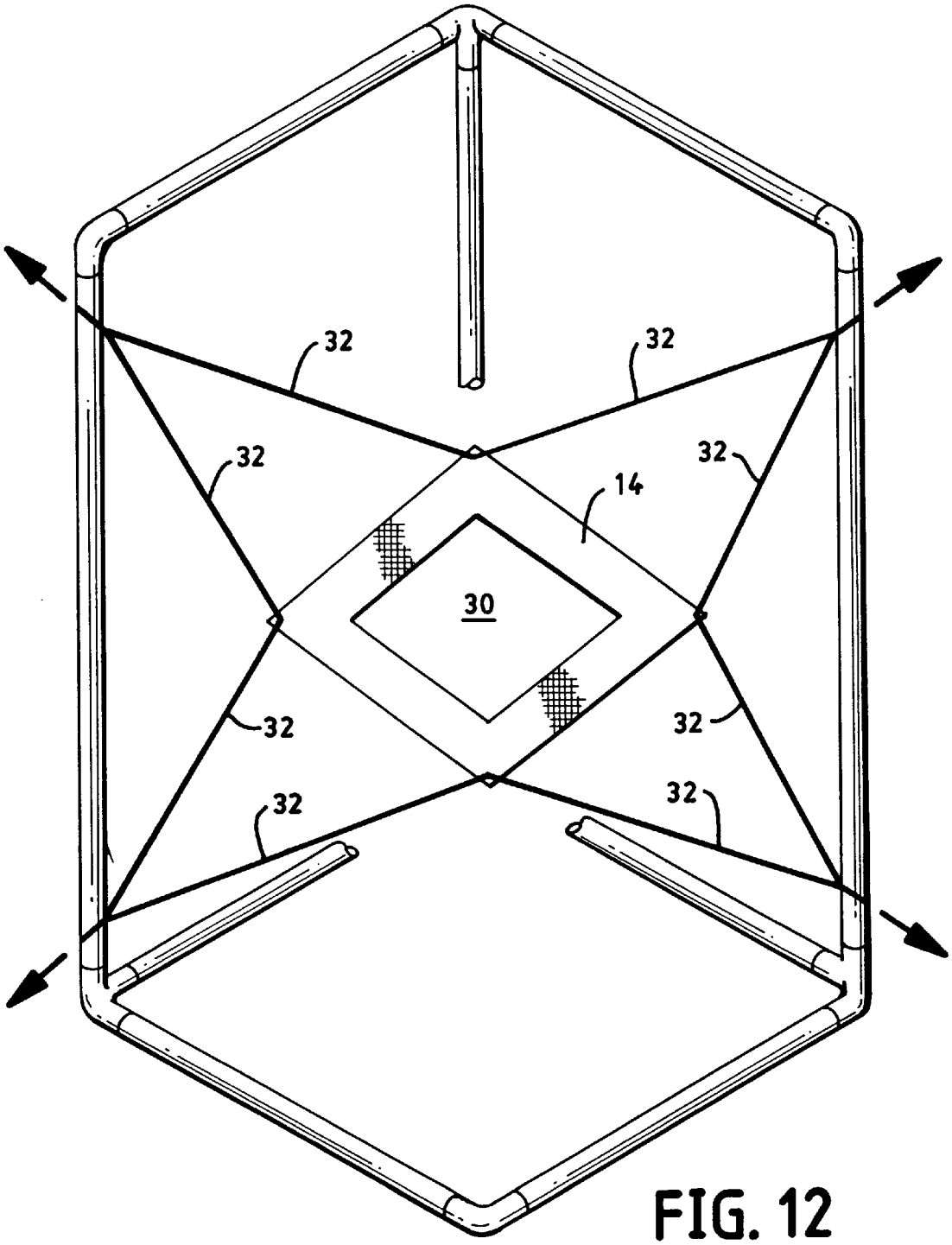
FIG. 12 illustrates how the target component mounts to the side members of the framework to this target game apparatus.

With reference to FIGS. 1, 4 and 12, the target 14 is rectangular in peripheral shape with a rectangular opening 30. The target 14 is suspended in the open framework 12 by a plurality of elastic straps 32 interconnecting the target 14 to the open framework 12. The four elastic straps 32 are under tension and are connecting the target 14 with loops 47 at hooks 46 equally spaced upon the two like vertical members or tubes 16 vertically and horizontally centered between the said like vertical side members or tubes 16 and the like horizontal members or tubes 20. The four elastic straps 32 are equal in length and each are connected at grommets 44 located equally around the perimeter of the target 14.

Figure 10:
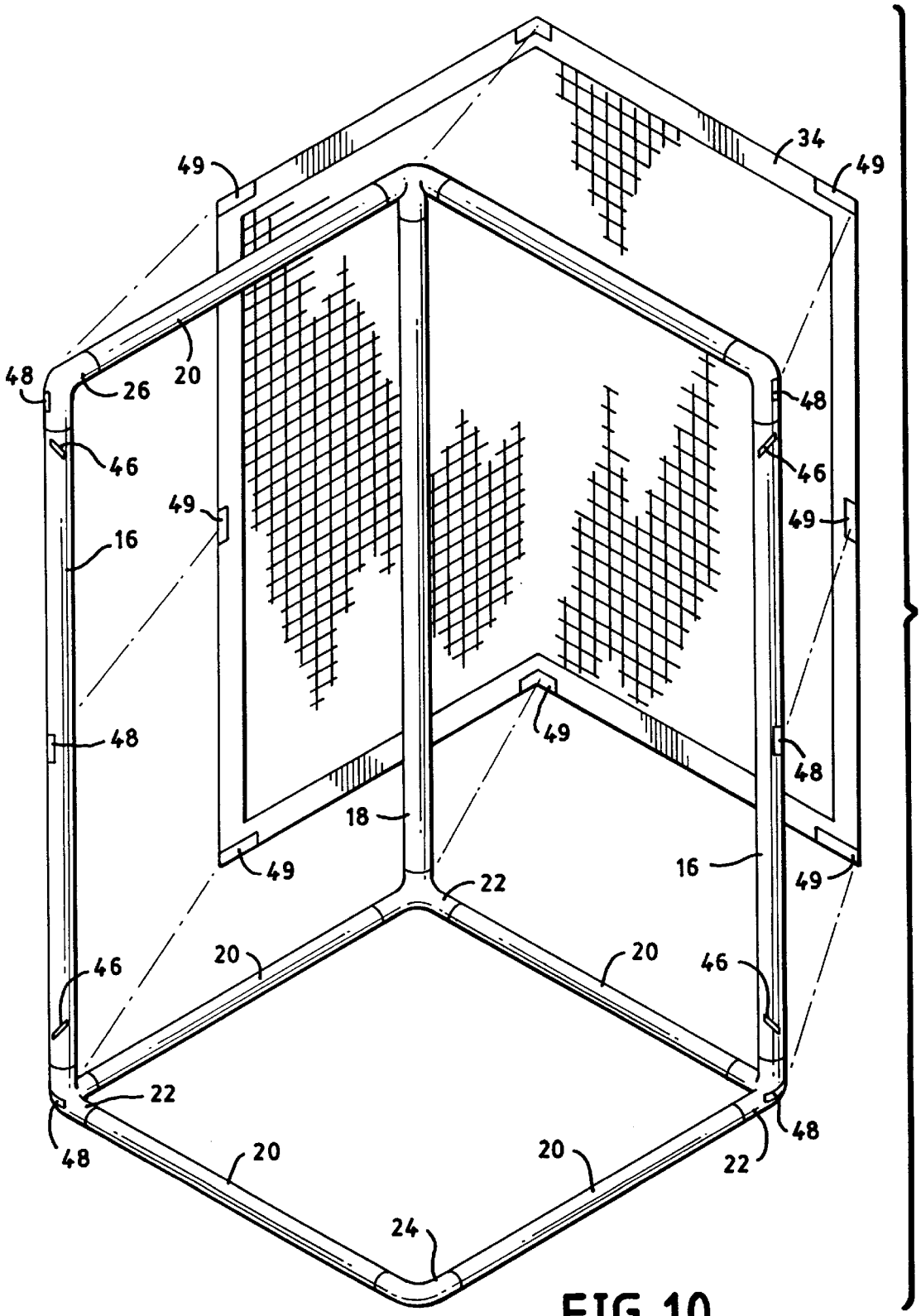
FIG. 10 illustrates how the net to retain the flying disc mounts to the rear of the framework of this target game apparatus.
Figure 11C:
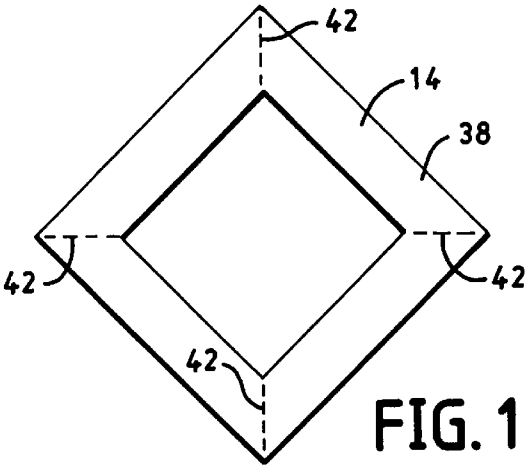
FIGS. 11A, 11B and 11C illustrate how the target component unfolds with four hinge joints to form the target to be mounted on the open framework of this target game apparatus.
Figure 11B:
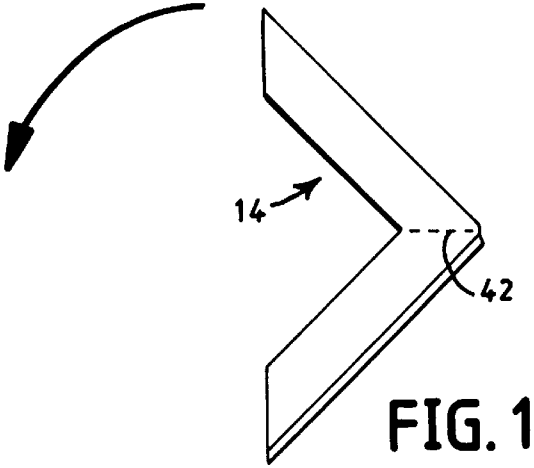
Figure 14:
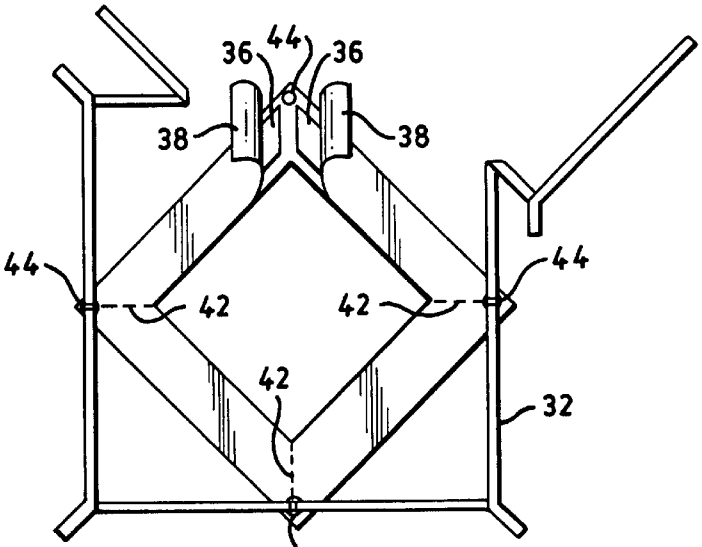
FIG. 14 is an illustration as to the construction of the target.
Figure 11A:
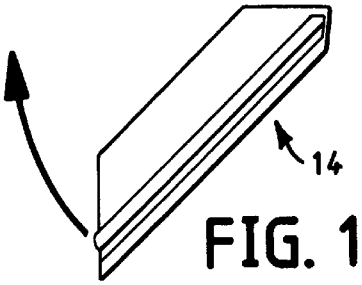

With reference to FIGS. 1, 4 and 10 the net 34 is rectangular in structure and is wider than tall and adheres with eight loops 49 to the back side of the open framework 12 at eight hooks 48 located on the four like three-way members or fittings 22, the two opposing two-way members or fittings 26 and 28, and also centrally located on the outsides of the like vertical side members or tubes 16. The net mesh should be fine enough so that the disk 51, or other device thrown at the target 14 will be stopped by the net and not pass through it.

With reference to FIGS. 4, 11A–C, and 14 the target 14 includes four inner armature members 36 covered with a fabric 38. The said armature members 36 are fabricated of a rigid material such as corrugated paper or plastic and the fabric 38 can be a moisture-proof material such as plastic or vinyl. The target 14 also includes four hinge joints 42 created by the fabrication of the four armature members 36 being of smaller size than the fabric 38. The hinge joints 42 are formed by fold lines fabricated in the target 14, so as to fold the target 14 when removed from the open framework 12 for ease of storage of the target game apparatus 10. The hinge joints 42 also utilize four grommets 44 that are placed at locations in said hinge joints 42 so as to attach the plurality of elastic straps 32 equally around the perimeter of the target 14.

With reference to FIGS. 1, 12–14, the target 14 suspended by elastic straps 32 under tension with the four rigid armature members 36 creating a rebound effect when the article thrown, a flying disc 51, strikes the target 14 directly on the fabric 38. The rebound effect adds to the accuracy needed to thrown the flying disc 51 through the scoring areas 30, 40, and 50 of the target game apparatus 10, shown in FIGS. 2 and 13.

Figure 2:
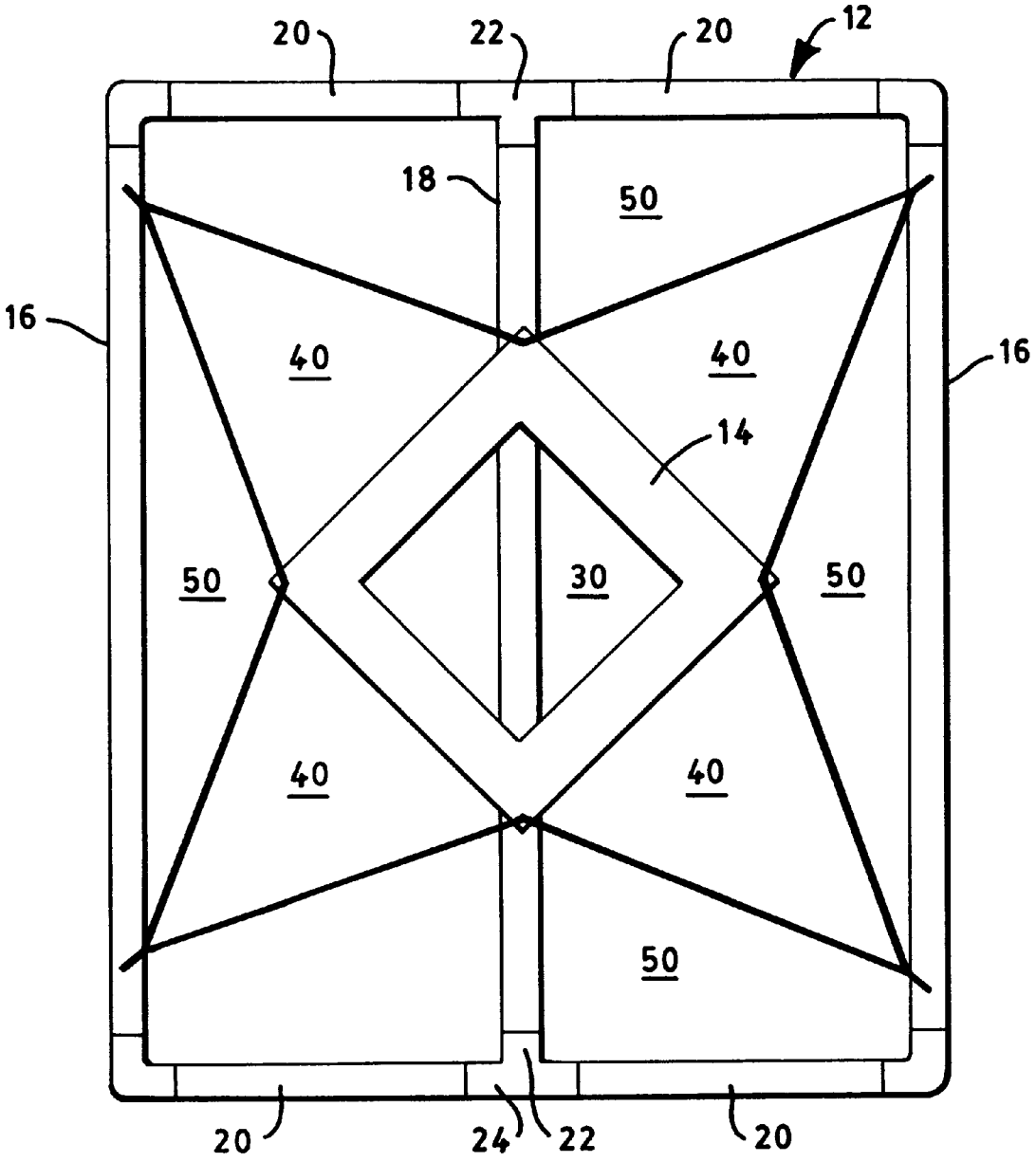
FIG. 2 is an illustrated indirect front view of the target game apparatus in its erected form showing the point scoring areas, the net removed.
Figure 13:
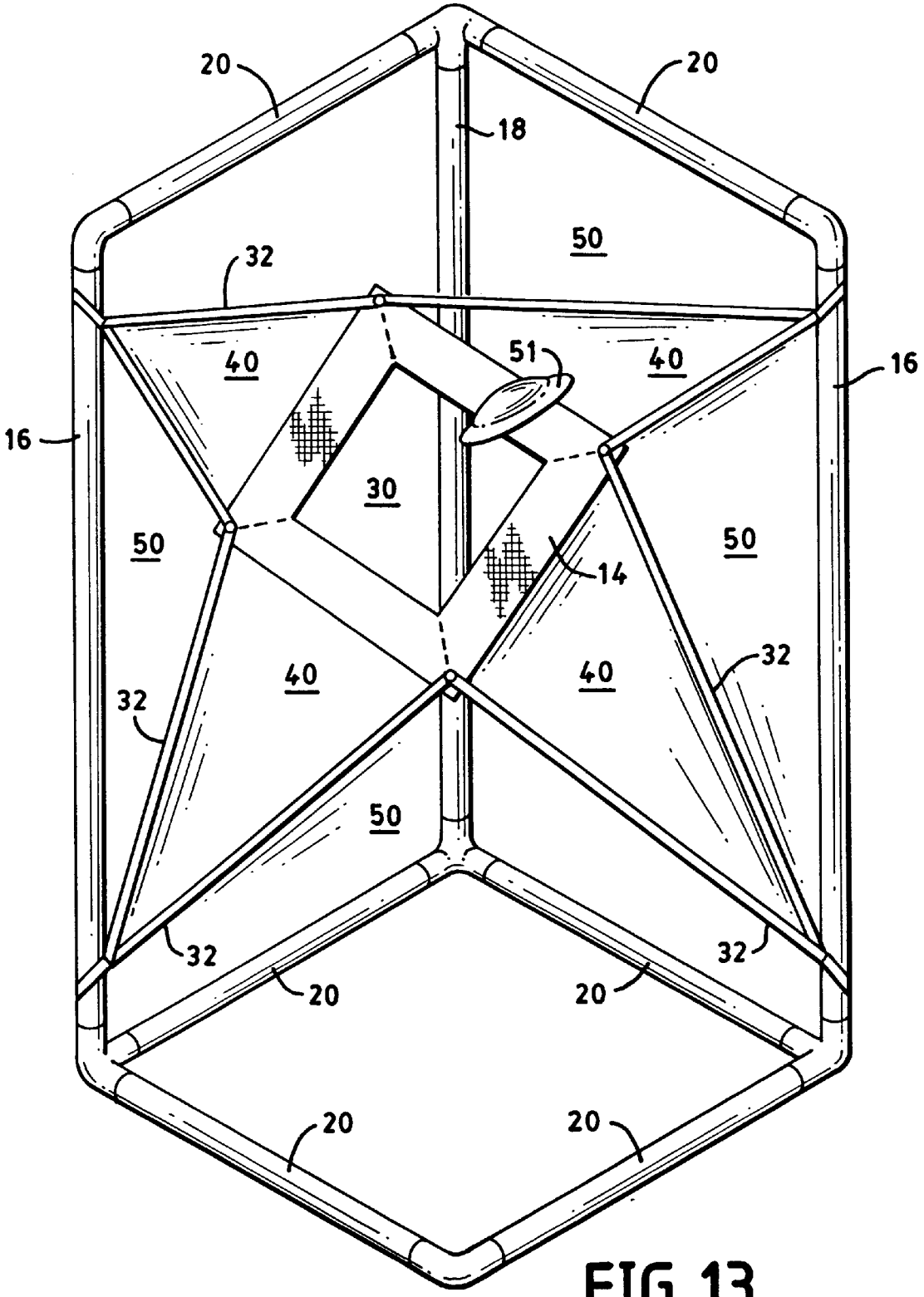
FIG. 13 is an illustration to show how points are scored with the flying disc thrown at this target game apparatus, the net removed.

Now with reference to FIGS. 2 and 13, points are scored by the participant(s) throwing the flying disc 51 through designated scoring areas 30, 40, and 50 with the highest amount of points, twenty five, being scored through the center of the target 14 rectangular opening 30, the second highest amount of points, ten, through the four triangular areas 40 created by the tensioned elastic straps 32 and the lowest amount of points, five, through the four outside perimeters 50 of the target 14 and the elastic straps 32 yet within the confines of the target game apparatus 10.

In addition, the game apparatus unit is preferably packageable, meeting the limitations set forth by the U.S. Postal Service on size and weight for shipment world wide, with weight less than twenty five pounds. A single or multiple individuals can participate; the game target apparatus creates exercise and enjoyment; the game target apparatus is not limited or exempt from the disabled, handicapped, or the elderly; and the unit in its assembled state is child safe. Assembly or disassembly of the game apparatus takes less than five minutes with minimal mechanical knowledge; the unit can be erected indoors or outdoors; and, the assembled unit can be picked up and moved.

The foregoing detailed description is given primarily for clearness of understanding this invention or scope the appended claims.

I claim:

1. A game target apparatus for use with an article to be thrown at the apparatus, comprising:

a. a free standing open framework, wherein the open framework comprises:
   - two generally vertical, spaced-apart like side members;
   - one generally vertical spaced-apart plain rear member;
   - six generally horizontal spaced-apart like members;
   - four like three-way members or fittings to interconnect the vertical members and the horizontal members extending to the like side members base and the plain rear member at the base and top;
   - two opposing two-way members or fittings to interconnect the like vertical side members with the like horizontal members extending to the plain vertical rear member; and
   - one plain two-way member or fitting to interconnect the like horizontal members extending from the like vertical side members at the front of the unit;

b. a target disposed within the confines of the open framework;

c. a plurality of elastic strap members interconnecting the target to the open framework, the target and elastic strap members causing rebound effect when the article is thrown; and d. a net mounted to the open framework to retain the article thrown.

2. The game apparatus of claim 1, wherein the target comprises a rigid peripheral structure defining a central opening larger than the article to be thrown at the game target apparatus.

3. The game apparatus of claim 2, wherein the rigid target comprises of at least 4 hinge joints so as the target can be folded when removed from the open framework of the game target apparatus.

4. The game apparatus of claim 1, wherein the elastic strap members interconnecting the target to the open framework are connected to the target at locations equally spaced apart about the perimeter of the target.

5. The game apparatus of claim 4, wherein the elastic strap members are under tension.

6. The game apparatus of claim 4, whereas the tensioned elastic strap members cause a rebound effect when the target is struck directly.

7. The game apparatus of claim 4, wherein the target interconnected to the open framework by the elastic strap members can be applied by touch.

8. The game apparatus of claim 1, whereas no tools are required for assembly or disassembly.

9. The game apparatus of claim 8, whereas the unit is packageable.

10. The game apparatus of claim 9, wherein the packaged unit meets the limitations set forth by the U.S. Postal Service on size and weight and can be shipped world wide.

11. The game apparatus of claim 9, wherein the unit weight is less than twenty five pounds.

12. The game apparatus of claim 8, whereas assembly or disassembly takes less than five minutes with minimal mechanical knowledge.

13. The game apparatus of claim 1, wherein the net can be applied to the open framework by touch.

14. The game apparatus of claim 1, whereas a single or multiple individuals can participate.

15. The game apparatus of claim 1, whereas the game target apparatus is not limited or exempt from the disabled, handicapped, or the elderly.

16. The game apparatus of claim 1, whereas the game target apparatus creates exercise and enjoyment.

17. The game apparatus of claim 1, whereas the unit in its assembled state is child safe.

18. The game apparatus of claim 1, whereas the unit can be erected indoors or outdoors.

19. The game apparatus of claim 1, whereas the assembled unit can be picked up and moved.

* * * * *